US012245695B2

(12) United States Patent
Held

(10) Patent No.: US 12,245,695 B2
(45) Date of Patent: Mar. 11, 2025

(54) ROTATABLE WALL CUPBOARD PULL-OUT ELEMENT

(71) Applicant: Wolfgang Held, Hard (AT)

(72) Inventor: Wolfgang Held, Hard (AT)

( * ) Notice: Subject to any disclaimer, the term of this patent is extended or adjusted under 35 U.S.C. 154(b) by 0 days.

(21) Appl. No.: 17/435,401

(22) PCT Filed: Mar. 9, 2020

(86) PCT No.: PCT/EP2020/056182
§ 371 (c)(1),
(2) Date: Sep. 1, 2021

(87) PCT Pub. No.: WO2020/182716
PCT Pub. Date: Sep. 17, 2020

(65) Prior Publication Data

US 2022/0142364 A1 May 12, 2022

(30) Foreign Application Priority Data

Mar. 8, 2019 (EP) ..... 19161600

(51) Int. Cl.
*A47B 88/48* (2017.01)
*A47B 49/00* (2006.01)
*A47B 88/90* (2017.01)

(52) U.S. Cl.
CPC ..... *A47B 88/48* (2017.01); *A47B 49/004* (2013.01); *A47B 88/9414* (2017.01)

(58) Field of Classification Search
CPC ... A47B 88/48; A47B 88/9414; A47B 49/004; A47B 96/025; A47B 77/10; A47B 63/062; A47B 2063/005; A47B 2220/0011; A47B 88/60; A47B 46/00; F25D 25/027; A47F 5/0087
USPC ..... 312/322
See application file for complete search history.

(56) References Cited

U.S. PATENT DOCUMENTS 1,010,950 A * 12/1911 Prather ..... A47B 88/48 312/123
1,406,129 A * 2/1922 Woltz ..... A47B 88/48 312/334.44
2,647,812 A * 8/1953 Saunders ..... F25D 25/027 312/294
2,650,871 A * 9/1953 Holderegger ..... A47B 88/48 16/374
3,982,800 A * 9/1976 Gorton ..... A47B 49/006 312/238
4,065,196 A * 12/1977 Stein ..... A47B 88/57 384/19
4,124,262 A * 11/1978 Schill ..... A47B 49/004 312/307
4,582,372 A * 4/1986 Cooper ..... A47B 81/002 312/307
5,221,134 A * 6/1993 Grass ..... A47B 88/956 312/348.2

(Continued)

FOREIGN PATENT DOCUMENTS

CH 663883 * 1/1988 ..... A47B 11/00
WO WO-2018192969 A1 * 10/2018 ..... A47B 49/006

*Primary Examiner* — Hiwot E Tefera
(74) *Attorney, Agent, or Firm* — John Alumit

(57) ABSTRACT

The present invention relates to a cupboard having a carcass and a drawer, wherein an adjustment mechanism is provided, by means of which the drawn is linearly displaceable and is supported rotatably about an axis.

8 Claims, 18 Drawing Sheets

(56) References Cited

U.S. PATENT DOCUMENTS

Figure 1:
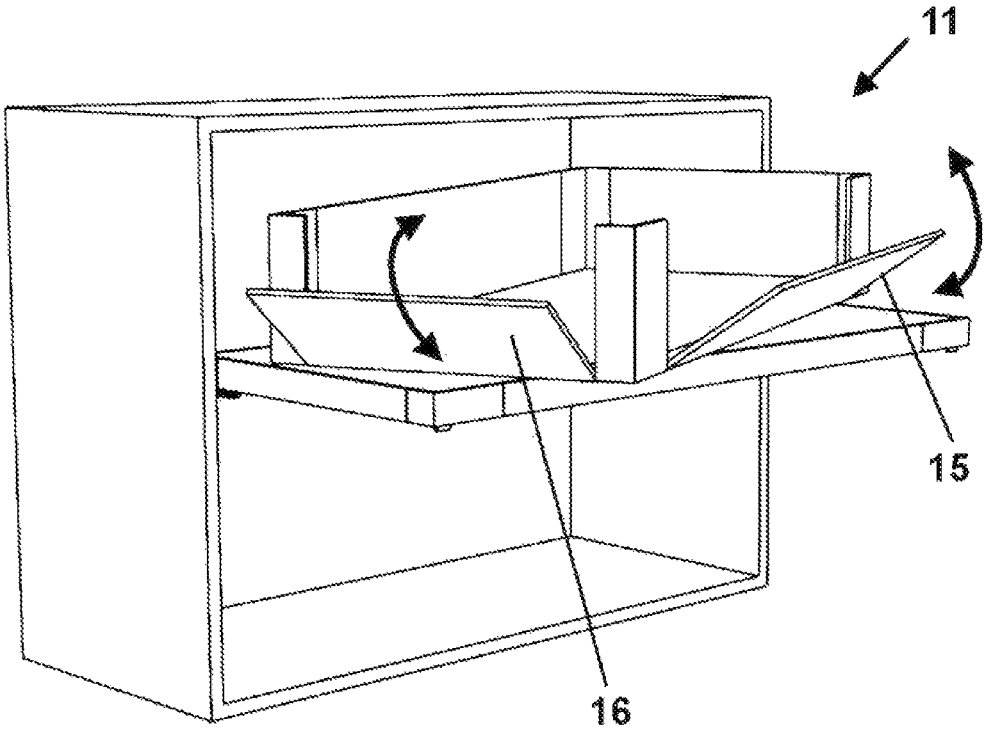

| | | | | |
|---|---|---|---|---|
| 6,161,806 | A * | 12/2000 | Crosson | F16M 11/18 248/371 |
| 6,206,495 | B1 * | 3/2001 | Peterson | A47B 46/00 312/283 |
| 8,459,474 | B2 * | 6/2013 | Sagel | A47B 49/006 211/144 |
| 9,004,297 | B2 * | 4/2015 | Sjolander | A47F 1/12 211/163 |
| 10,334,967 | B2 * | 7/2019 | Mercier | A47F 5/0093 |
| 2003/0107305 | A1 * | 6/2003 | Kusztal | A47B 21/03 312/265.4 |
| 2010/0060114 | A1 * | 3/2010 | Baird | A47B 88/48 312/334.1 |
| 2010/0102689 | A1 * | 4/2010 | Chambers | A47B 88/48 312/257.1 |
| 2013/0146552 | A1 | 6/2013 | Grimes | |
| 2014/0265788 | A1 * | 9/2014 | Judge | H05K 7/1489 312/334.1 |
| 2016/0045039 | A1 * | 2/2016 | McGregor | A47F 5/02 211/144 |
| 2019/0167000 | A1 * | 6/2019 | Storck | A47B 88/48 |
| 2020/0187641 | A1 * | 6/2020 | Rehage | A47B 96/025 |
| 2021/0145170 | A1 * | 5/2021 | Trombettoni | A47B 81/02 |

* cited by examiner

ROTATABLE WALL CUPBOARD PULL-OUT ELEMENT

The present invention relates to a cupboard having a carcass, a shelf, and an adjusting mechanism, with which mechanism the shelf can be shifted linearly, and a swivel joint about the rotary axis of which the shelf is supported rotatably on the adjusting mechanism, in accordance with the preamble to claim 1.

In such a cupboard, there is a constant need for an easy way to reach stowed objects that are located in the rear area of the cupboard. If the cupboard is a lower cupboard, for example, a drawer system can for instance be provided, which can be pulled out of the carcass of the cupboard and can make it easier to move the shelf at least partway out of the carcass of the cupboard. If the cupboard is an upper cupboard, it helps only somewhat to pull it out, since the objects located in the middle-rear part are still hard to reach.

The fundamental object of the present invention is to disclose a cupboard which can be used as both an upper cupboard and a lower cupboard, in which access to the rearward region of the shelf is made easier compared to the prior art.

According to the invention, the object is attained by means of the definitive features of claim 1.

According to the invention is can be provided that at last one retention mechanism is furnished which is embodied for reversible fixation of the shelf in a predetermined rotary position, the retention mechanism having a resilient which and a retention element that can be fixed reversibly in the receptacle.

Both parts of the retention mechanism, in particular the resilient receptacle and the retention element, are capable of jointly supporting the shelf in at least one position. This can be the case in particular if the reversibly fixable element obtained is located inside the resilient receptacle.

In that situation, a first part, for example the resilient receptacle, can be provided on a static part of the shelf or of the adjusting mechanism. The other part, for example the retention element, which can also be called an engagement element, can be located on a rotatable part of the shelf, in particular on the rotatable shelf. Especially preferably, the retention element can be located on the rotatable part of the revolute joint, and/or the cushioning receptacle can be located on a stationary part of the revolute joint.

A stationary part of the shelf or of the revolute joint can be a region of the adjusting mechanism or revolute joint that is furnished for receiving, or being joined to, the revolute joint or the rotatable part of the revolute joint in order to accommodate the rotary motion of the shelf.

This stationary part can be pulled out of the cupboard by means of a part of the adjusting mechanism that can also be pulled out, and/or the stationary part can form a base on which the revolute joint or the rotatable part of the revolute joint is located. The stationary part can for example be a be a retractable board, or the stationary part can be located on the retractable board.

The retention mechanism can also serve as a positioning means, a fixation means, or a retention means.

The cushioning receptacle can also be called a a element and/or slaving means and/or a shaping spring and/or simply a receptacle.

The retention element can also be called a portable element, or an engagement element.

According to the invention, an adjusting mechanism can be provided by means of which the shelf can be slid linearly and is supported rotatably about an axis. By this means, especially after the shelf has been pulled out (linear displacement), a rearward region of the shelf can be more easily accessible from the side or from the front by rotating the shelf by a desired angle, for instance by 90° or 180°. The invention is for example achieved at least whenever a rotatable pull-out device (shelf) is furnished.

Fundamentally, the adjusting mechanism can be embodied in one piece or in multiple pieces. In particular, the pull-out device can be furnished such that the shelf can be shifted linearly, and preferably, the shelf is furnished such that it can be pulled all the way out.

Especially preferably, it is provided that the adjusting mechanism has a pull-out device, which in particular can be pulled out at an angle or crosswise for the sake of shifting the shelf linearly.

The scissors or crosswise pull-out device can be embodied with one or more scissors units or elongated means that are connected in articulated or displaceable fashion one after another; a scissors unit has at least two means, in particular arms, that are connected to one another at a point or along an axis in articulated or displaceable fashion. Especially preferably, a pull-out scissors device or crosswise pull-out device is formed with at least two scissors units, which can be connected to one another by their respective ends. For example, in an end region of the pull-out scissors device or crosswise pull-out device, a rotating device can be provided by means of which the shelf can be rotated relative to the body of the cupboard, in particular about a (vertical) axis.

The pull-out scissors device can be secured/locked both on the two side elements walls of the carcass and on the back wall, the side walls, and/or the floor of the carcass. For example, the pull-out scissors device can also be furnished in the form of one or more rails which, for instance from below, are furnished in or connected to a freely adjustable region between the side walls of the shelf. In this respect, instead of being connected to the side walls, the pull-out scissors device can also be secured to at least one of the three regions of the carcass that have been mentioned. In particular, this can make possible a greater maximum width of the shelf inside the carcass, since that does not require any space for the pull-out scissors device on the sides of the shelf or of the adjusting mechanism.

For especially optimal utilization of space, the shelf can be approximately the same basic shape as the carcass. In particular, this shape can be a square or rectangular. The size of the shelf, especially if the shelf is square or rectangular, can be large enough that free rotatability of the shelf inside the carcass in a retracted position is prevented by the side walls and the back wall. In such a situation, free mobility is made possible only when, by a linear displacement of the adjusting mechanism or the retraction device, the shelf is moved outward so far out of the carcass that upon rotation, the corners of the shelf 11 move past the side walls. This is ensured in particular whenever the shelf 11 is moved all the way out of the carcass, or the shelf 11 is so much smaller than the base of the carcass that free rotatability is enabled even if the shelf has been moved partially of the carcass, or if the shelf 11 is so much smaller than the base of the carcass that free rotatability is enabled even if the shelf has already been moved partway out of the base body.

The present invention is intended in particular to make a contribution when free rotatability of the shelf inside the carcass is already fundamentally impossible because of the dimensions of the shelf.

Preferably, it is provided that the adjusting mechanism is secured to an inner back wall and/or side wall of the carcass. As a result, the adjusting mechanism can be provided entirely inside the interior of the carcass. Particularly in the event of simultaneous fastening onto the back and side walls or onto the back wall, top, and/or base, firmer anchoring of the adjusting mechanism to the carcass can be provided, because particularly when the drawer has been pulled out, a layer filled with heavy filler material can exert increased leverage on the connecting elements between the adjusting mechanism and the carcass.

Expediently, it can be provided that the adjusting mechanism has fixation means which releasably define the shelf and/or the adjusting mechanism in an outward-extended position. To make a shelf possible that can be rotated easily relative to the carcass, it can be necessary to pull the shelf out of the carcass at least far enough that, upon a rotary motion, the advantageously rectangular or square shelf can be moved past the side walls of the carcass. If, for example by contact with a person using the system, the adjusting mechanism is to be returned at least partway back in the direction of a retracted position of the shelf, the shelf may be prevented from freely rotating. The shelf can be fixed by fixation means in an extended position, in which the drawer protrudes far enough out of the carcass to make free rotation possible. As a result, damage from a rotation of the shelf on the walls of the carcass can be averted.

It is especially preferably provided that the fixation means has at least one wheel, preferably spring-supported, which engages a wall of the carcass from the top or from behind in the region of the opening of the carcass, thereby fixing it. In principle, an arbitrary fixation means for locking the shelf or for locking the pull-out device or in an extended position can be furnished that can be easily released again, in order to make it easy to return the shelf into the carcass of the cupboard.

In one embodiment, at least one wheel, or an element fitting over or behind a wheel, can be provided which is braced on an arbitrary carcass wall, counter to the direction in which the carcass wall is introduced into the interior of the carcass in a retracted position. For example, this can be a front edge of a side wall, lid, or floor of the carcass, or of an outer side of the side wall, of a cover, or of a base of the carcass. In both cases, the fitting over the top of the wheel or behind the wheel can lead overall to resistance or retention or stopping of the adjusting mechanism, and this retracted position in the interior of the carcass. In particular, the wheel can be spring-supported, as a result of which, by overcoming a related counterpressure on the shelf or on the extraction device, it can be put by a user into an outset position, which can make it possible to reposition the shelf from the pulled-out position to the retracted position back inside the carcass.

To undo locking of the shelf, for instance by means of the wheel, a release mechanism can also be provided, which upon actuation moves the wheel or the locking means out of the working position, in which it fits over or behind, back to a retracted position of repose, which makes it possible to reposition the shelf from the extended position to the retracted position inside the carcass. In principle, an opening can be the region in which a cupboard door or a facing is typically located, so as to conceal the door or facing.

In a further refinement of the invention, it is especially expedient that the adjusting mechanism has a rotation device for rotatably shifting the shelf. The rotation device can fundamentally be a bearing, a turntable, or some other element which enables the rotation of the shelf relative to the adjusting mechanism. To furnish the largest possible supporting surface, which in particular is embodied as a board or a double board, and in particular in the case of the double board, one board can be secured to the adjusting mechanism, and the other board can be secured to the shelf. The two boards of the double-platter arrangement can be rotatable relative to one another, whereby a sufficiently large shelf area is furnished, which absorbs the forces that occur if the supporting area is unilaterally stressed or if one side of the shelf is pulled downward and thereby protects or spares the applicable bearing or bearings.

Particularly for attaining a defined rotatability of the shelf, it can be provided that the rotating device is embodied for locating the shelf rotatably in at least two directions. For example, it may be expedient to define a first position, in which the shelf is in an outset position. The outset position can in particular be the position in which the shelf can easily be slid into the carcass. In that position, one lateral edge of the carcass can for example be oriented approximately parallel to a lateral edge of the shelf. A second orientation can be provided in an arbitrary (rotational) angle that is different from that of the first position. A rotation of 90° or by 180°, 270°, or 360° (or less than 360°) can be especially expedient; that is, the second orientation may differ by 90° or by 180°, 270°, or 360°, or an arbitrary angle between them. In particular, it can be provided that the shelf can be fixed in the first orientation. In principle, the second position can be defined such that upon a rotation of the shelf, the shelf is located in an oblique position relative to the carcass, such as 100°, 290°, and so forth.

It can be expedient to provide that at list one fixed position in at least one orientation of the shelf is furnished, in which the shelf can be releasably lockable or releasably fixable. An especially expedient fixation can be in the form of a latch in which the shelf can be releasably latched or releasably fixed. An especially expedient fixation can comprise a latch, which can be furnished by means of a detent element. Such a detent element can be provided in each of the (two) fixable orientations, in order to make it possible to the shelf in the appropriate position or orientation. There can also be a detent element if this involves a receptacle for one region of the shelf or a middle part of the shelf in which the region or the middle part is fixed releasably. In particular, the detent element can have a guide link that has a slaving means for the region or middle of the shelf; the slaving means is able to firmly hold the middle or the region, in particular in a detent position. For undoing the (detent) connection, it may be provided that an initial resistance is intended to be overcome, or the middle or the region of the shelf is to be inserted still further into the latch, as a result of which the latch can be releasable. For that purpose, the guide link can be embodied with a corresponding track for releasing the region or the middle. The region or the middle can for example also involve a hook that can be guided in the link or supplied to the link.

The detent element can advantageously furnish a detachable connection to the shelf, as a result of which a simple change can be made between the individual orientations of the shelf. For connecting the detent element, an engagement means may be provided which can be embodied as a hook, a middle, or a region, for example, and which is furnished for engagement with the detent element in a way that fixes the shelf. Fundamentally, any means that can be secured to the shelf and can be releasably connected to the shelf is conceivable as an engagement means. The detent element can in particular be provided on the adjusting mechanism, in the region of the rotating device, particularly in the region of the turntable or double turntable. Fundamentally, the detent element can also be called a locking element. It can be furnished with the link guide, in which the receiving means for a pin, pivot, bolt or other element (means, hook, region, portable element) of the shelf is furnished.

The receiving means can in particular be a guide element, which receives the pin, pivot, bolt, or other element, and which is supported movably inside the link. The link guide can be furnished with a track for the guide element, which track can be approximately equivalent to the rotational motion of the shelf, or at least can complete this track. The guide element can furthermore be operatively connected to a spring, which when the shelf is being rotated can be tensed or relaxed, while the guide element is operatively connected to the pin, link, bolt, or other element of the receptacle (transfer element). Thus the spring can be tensed by means of moving the shelf, while the shelf is supplied with a defined orientation in which the shelf is given a defined orientation, in which the shelf or guide element (slaving means) can be locked (see FIGS. 11-15). Conversely, upon release of the detent connection of the guide element, the spring force can be used in order to move the transfer element of the shelf in the direction of a second defined orientation, after the detent connection is undone on its own. The transfer element can have a portable element that can interact with the at least one guide element and engage that element (FIGS. 11-15).

In this second orientation, in turn, a separate guide element with a further spring can be furnished, which is capable of interacting with the same transfer element of the shelf or a second transfer element of the shelf, again tensing a spring, and which can have a detent connection for fixation of the shelf in the second orientation.

It may be necessary, beginning at a first orientation of the shelf following a (rotation) point/region, in which the one (first) spring is already relaxed, yet the shelf has not yet locked in the second position, to tense the second spring counter to the spring tension thereof and to guide the shelf to the second orientation, for instance by hand. Between the relaxation of the first spring and the tensing of the second spring, a rotary region can be furnished between the first or second orientation, in which region both springs are tensed or both are relaxed, or in which neither the first nor the second spring has changed its status. In that region, the shelf can be freely rotatable about its axis, independently of the link guide or guide elements.

It is especially preferably provided that the shelf has foldable side walls that can be lowered toward the outside. The cupboard in accordance with the present invention can also have at least one of the following properties, which can be arbitrarily combined with one another.

The carcass has a basic body that is square-shaped;

the shelf has approximately the same shape as the carcass;

the shelf has approximately the same width as the pull-out device;

the first orientation is an outset position, in which the shelf can be received in its entirety in the carcass;

the second orientation can be provided, rotated at least 90° and preferably 180° around the axis relative to the first orientation;

the scissors mechanism has at least two scissors elements cooperating with one another;

the scissors mechanism has a bracing element, which is in guided contact with at least one of the scissors elements.

The present invention will be described further, based on the accompanying drawings.

Shown in the drawings are

Figure 2:
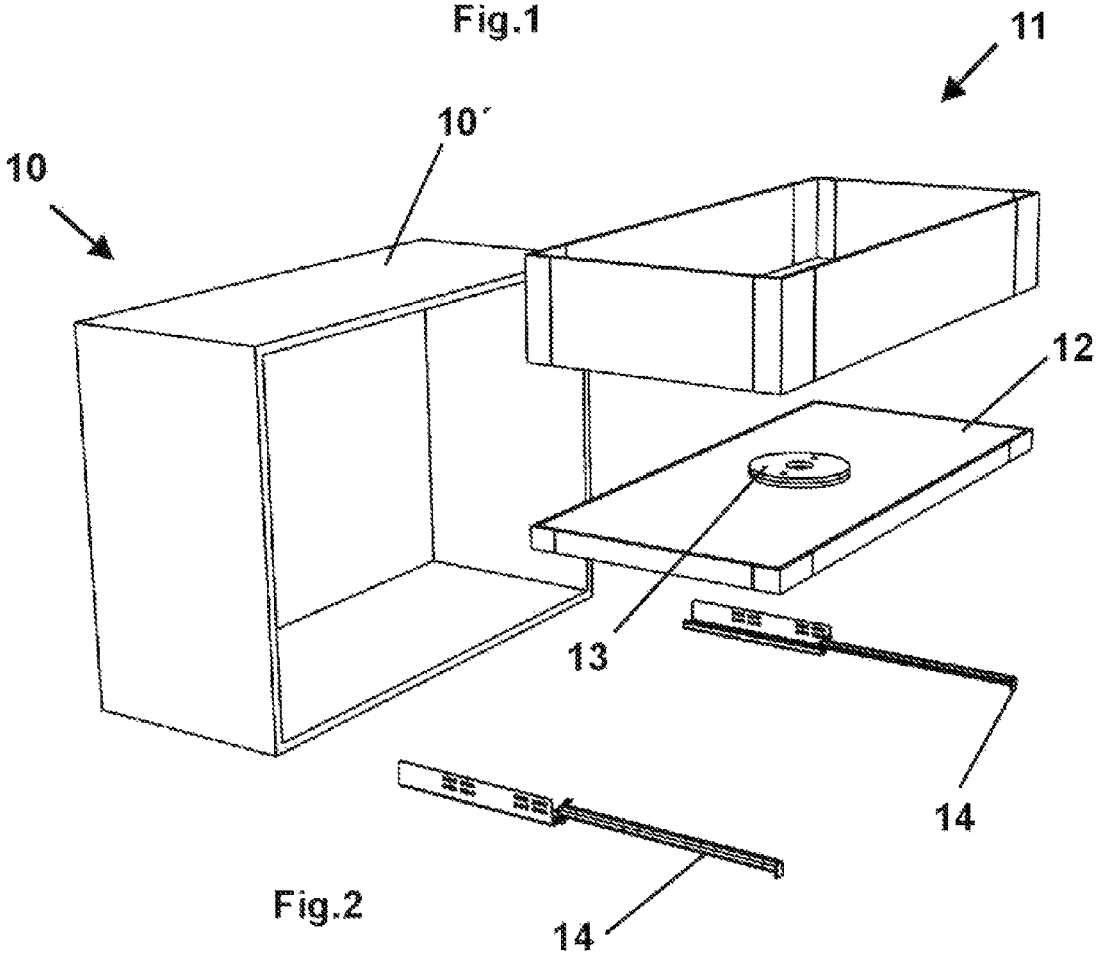
Figure 3:
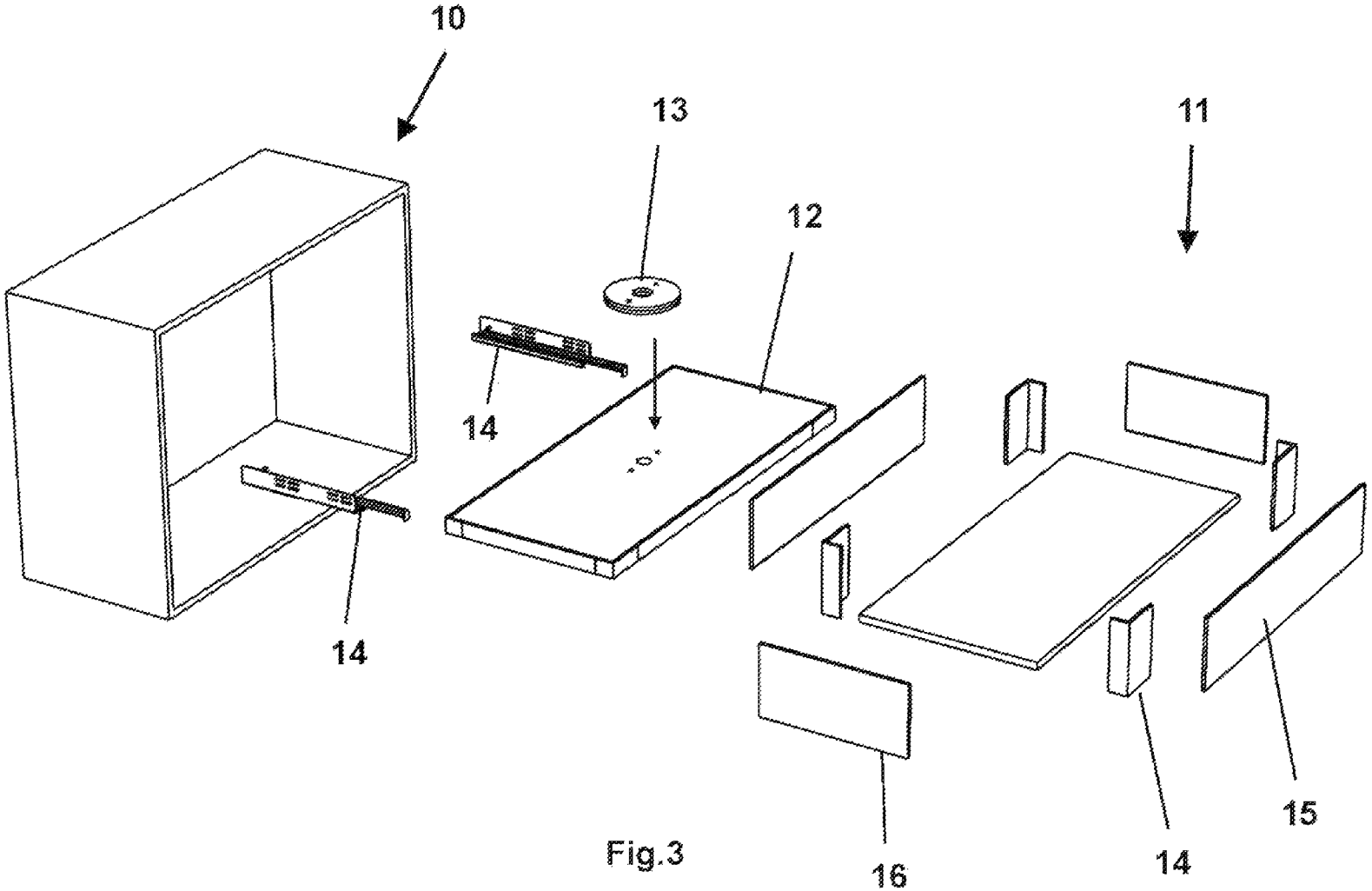
Figure 4:
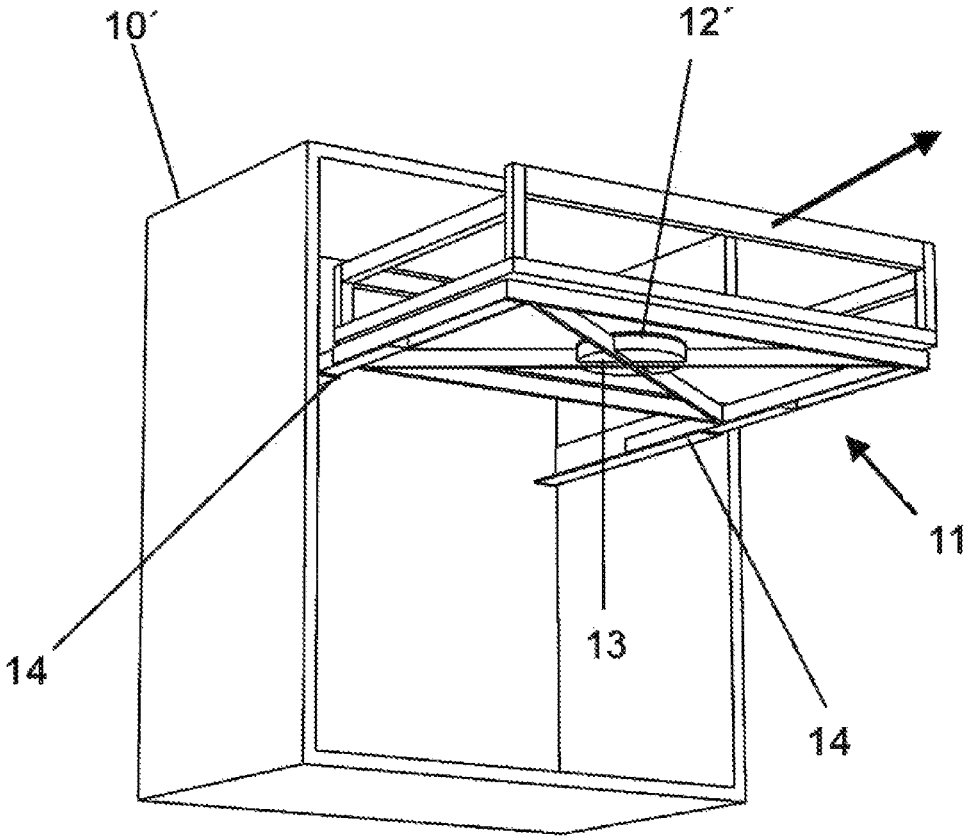
Figure 5:
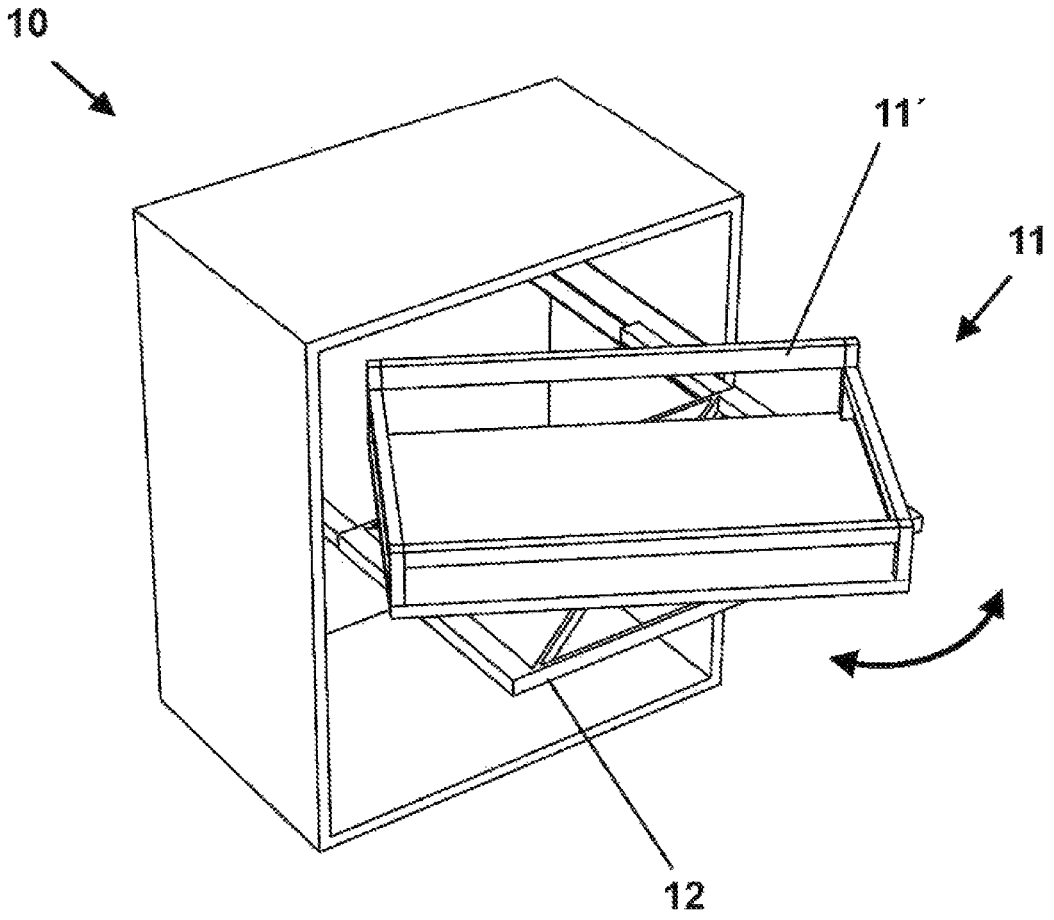
Figure 6:
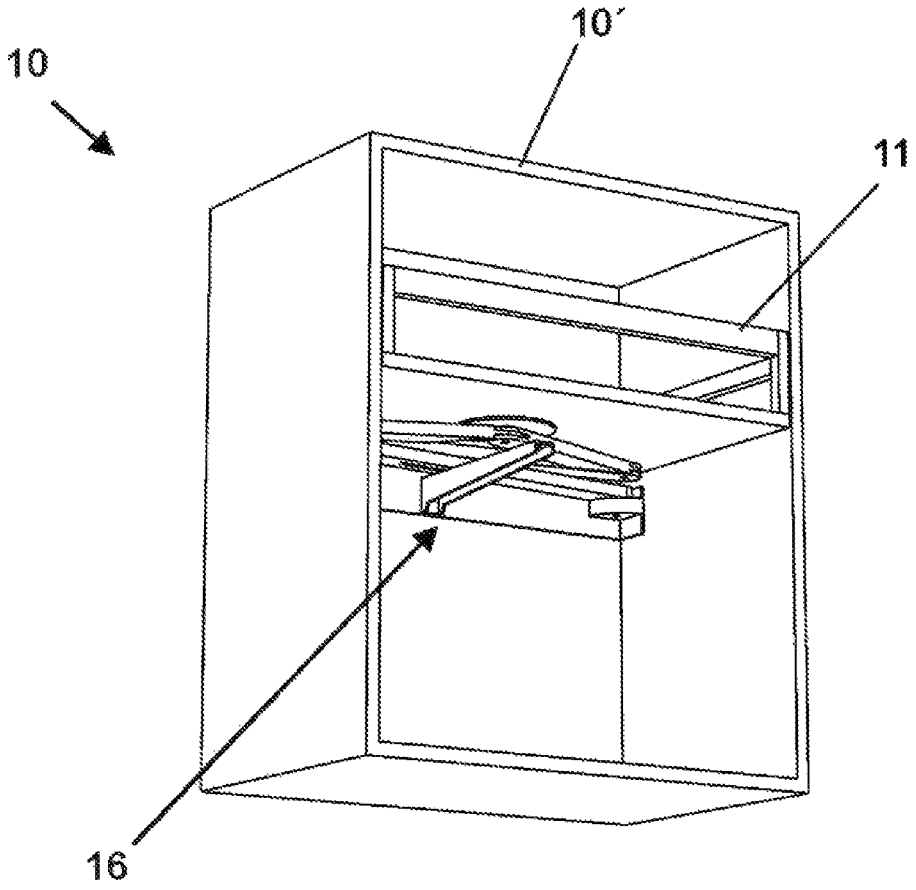
Figure 7:
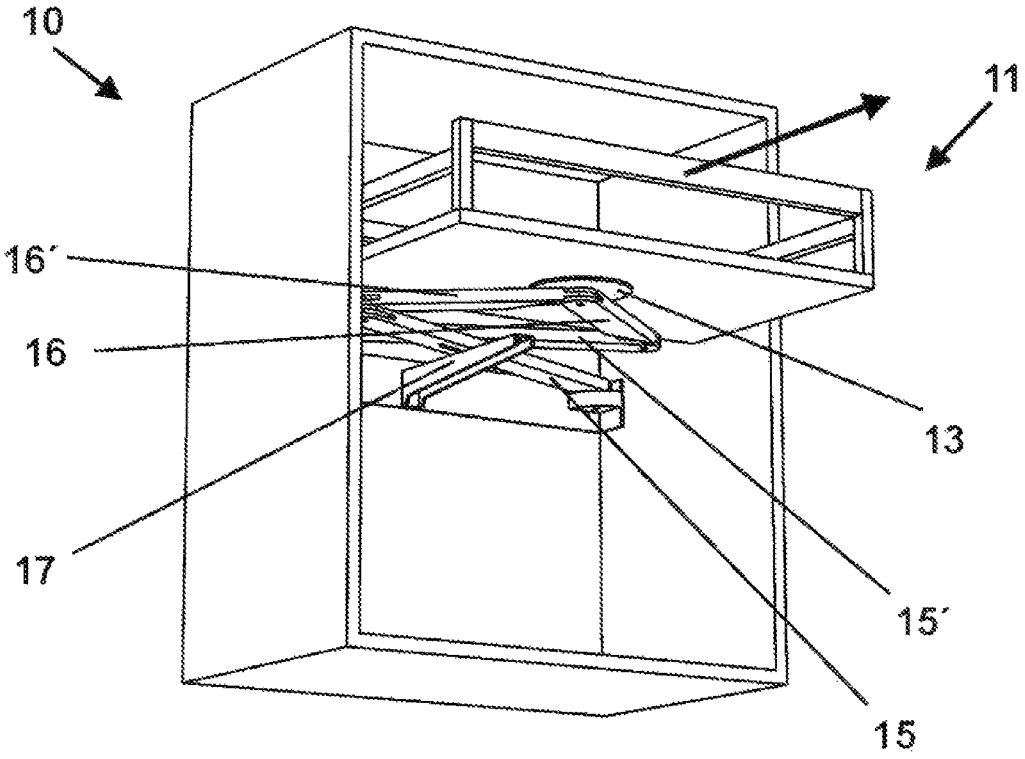
Figure 8:
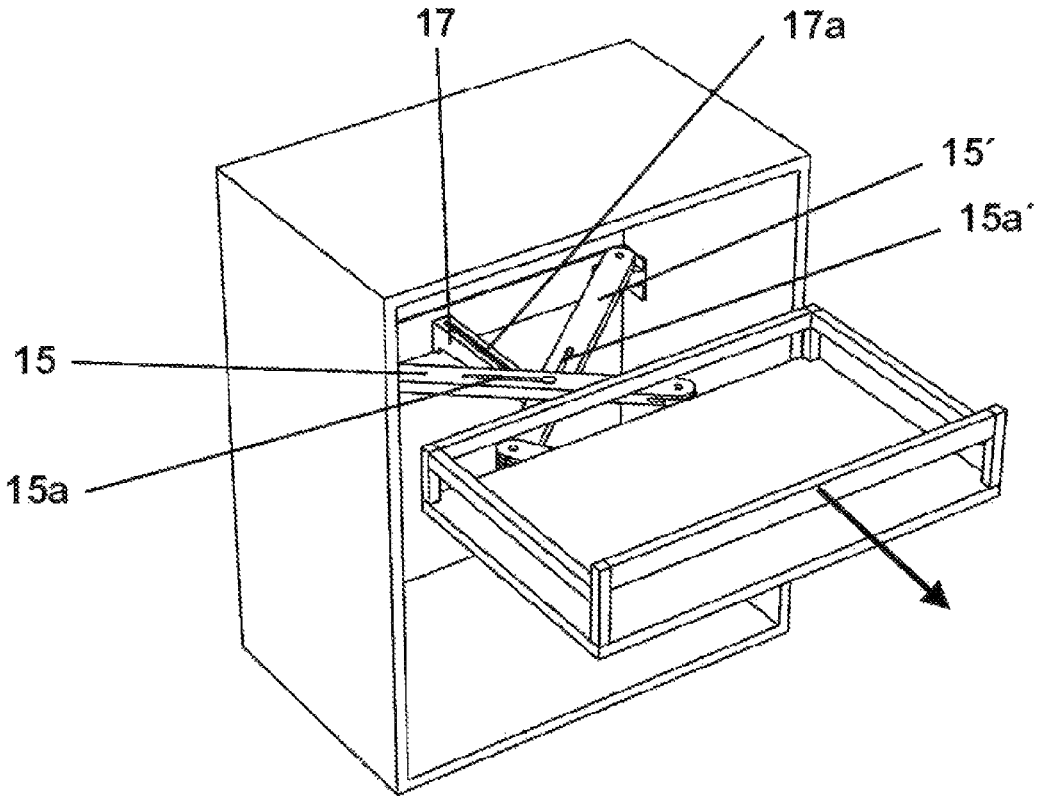
Figure 9:
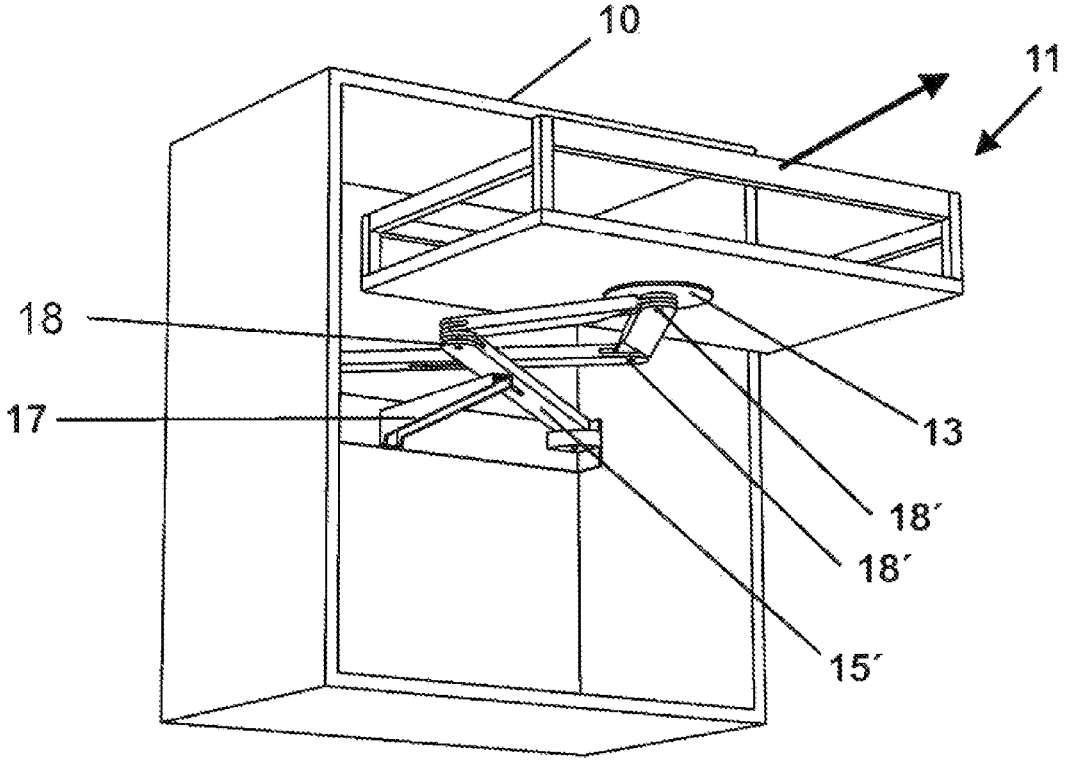
Figure 10:
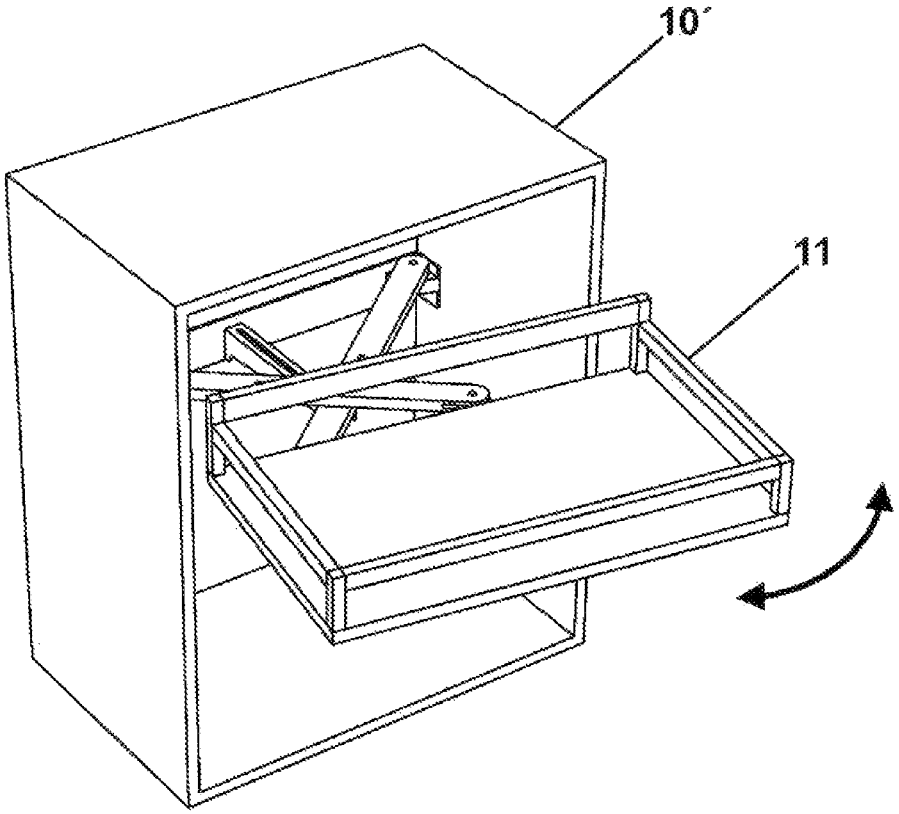
Figure 11:
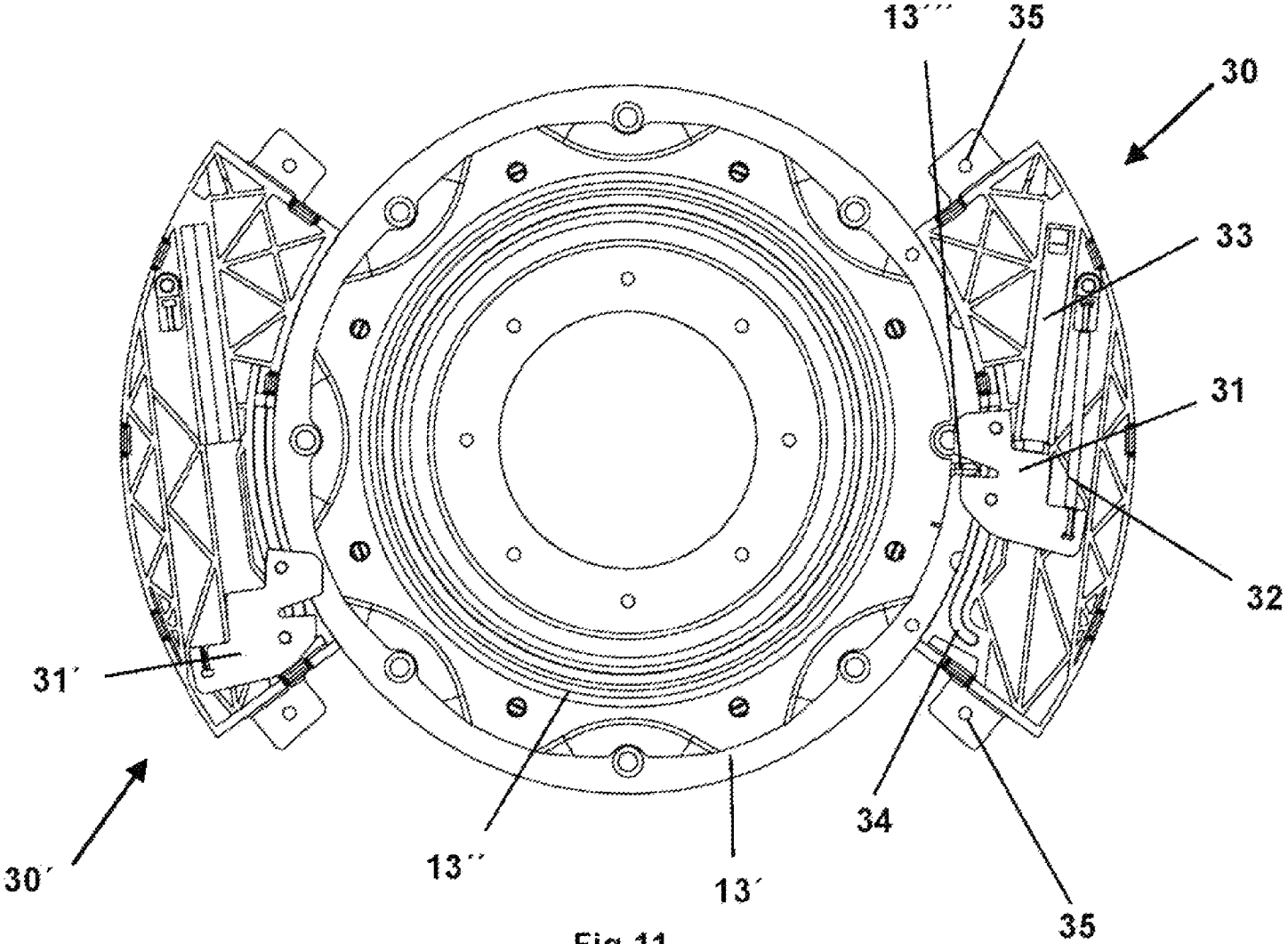
Figure 11:
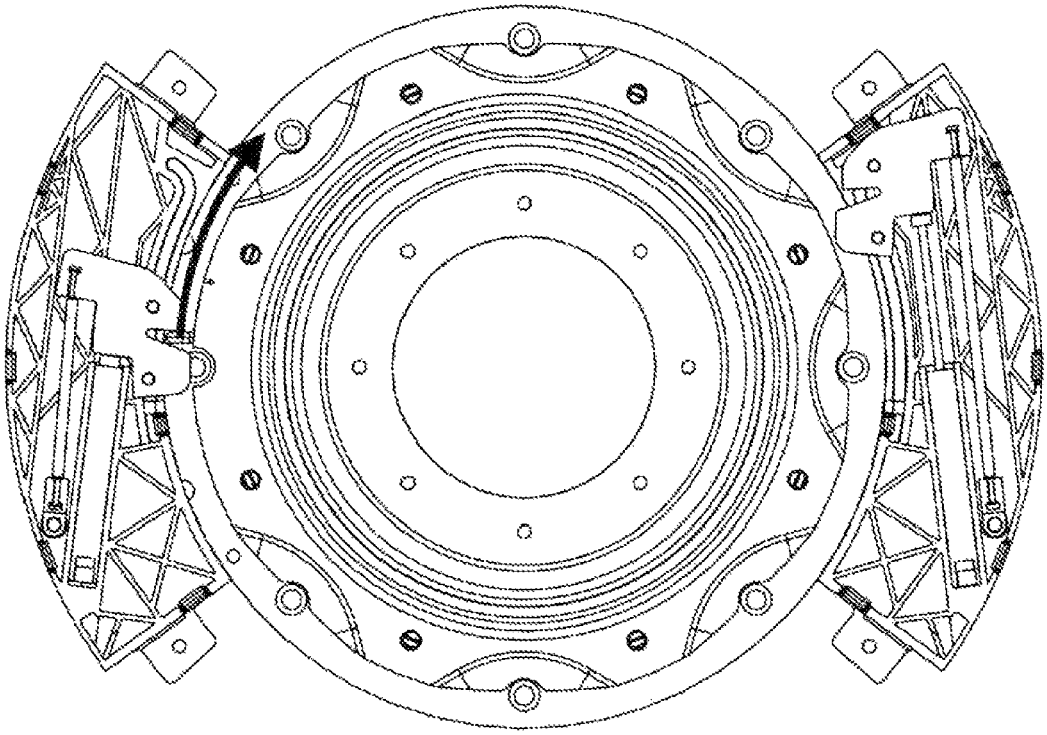
Figure 12:
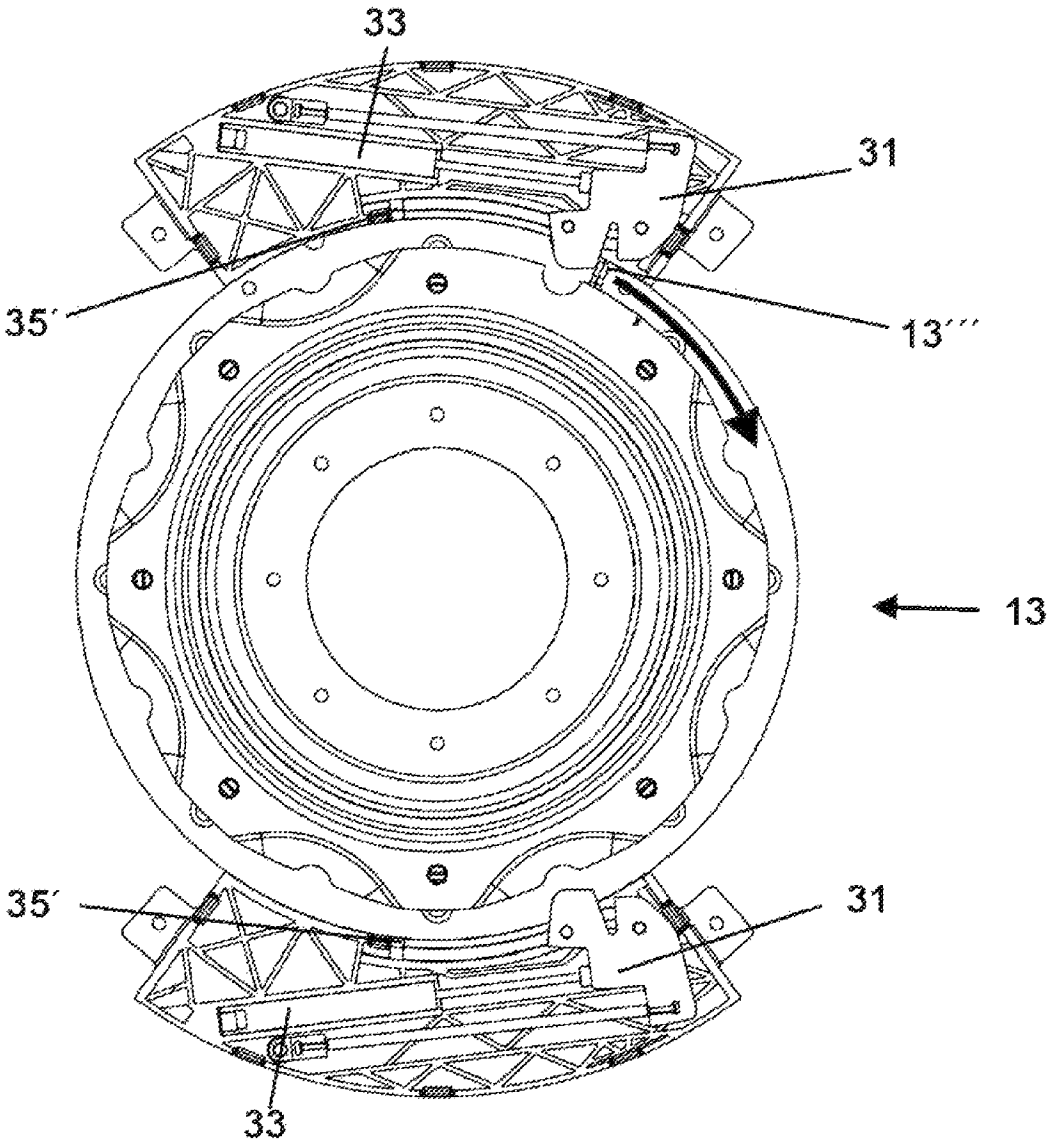
Figure 13:
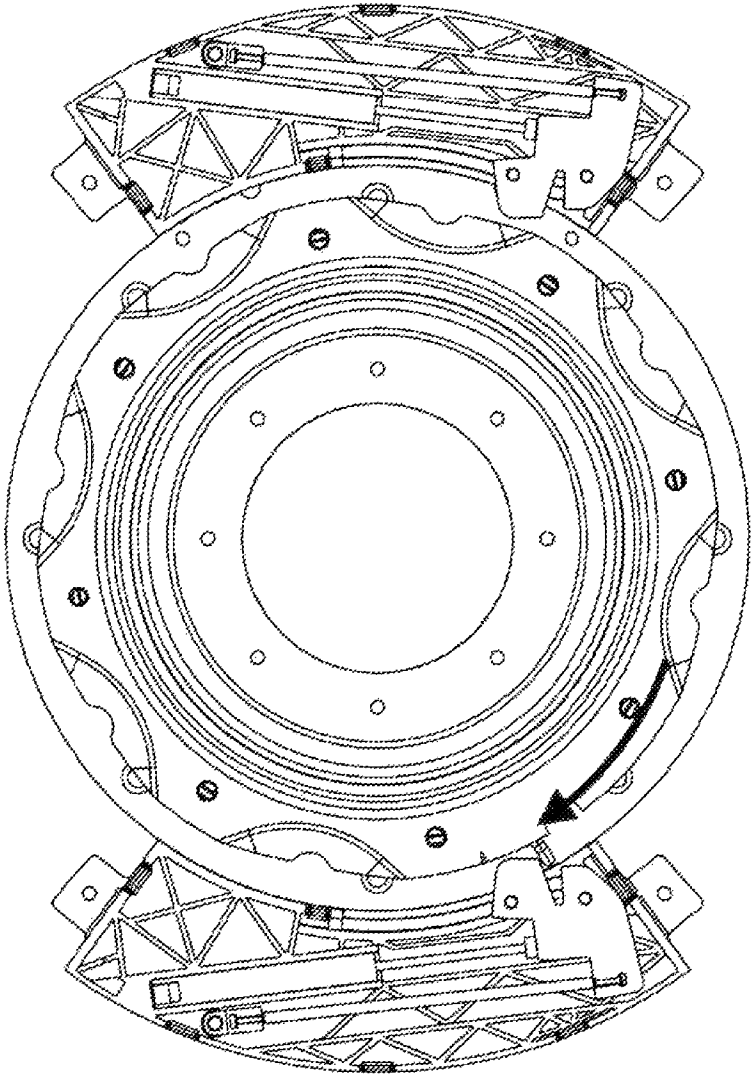
Figure 14:
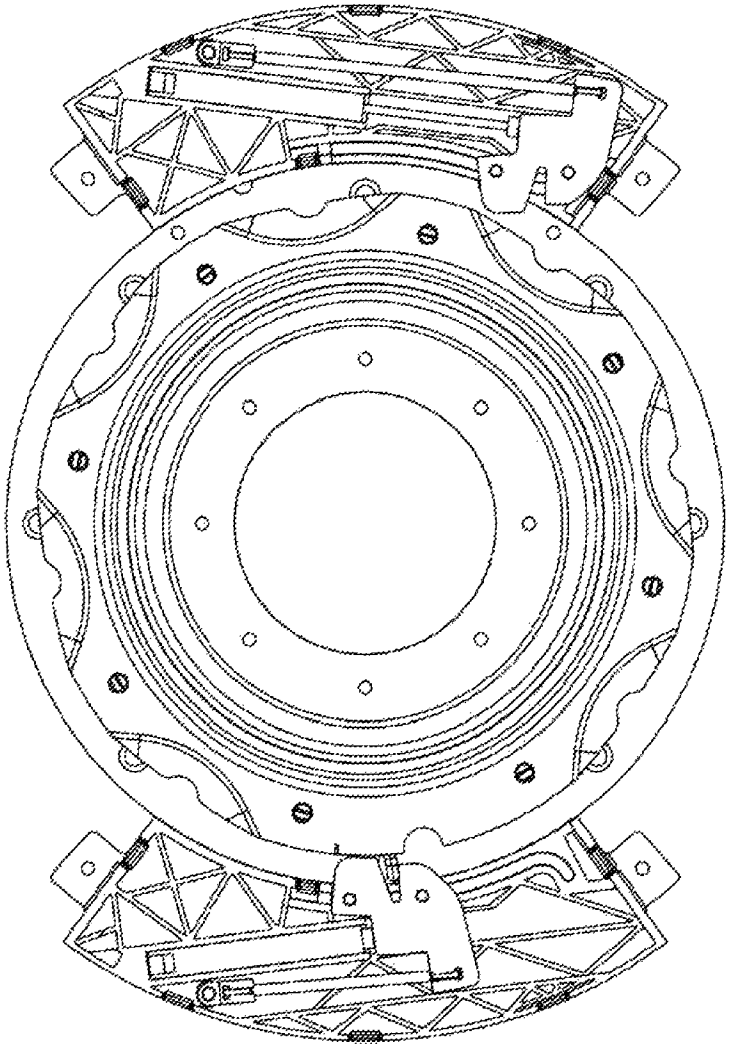
Figure 15:
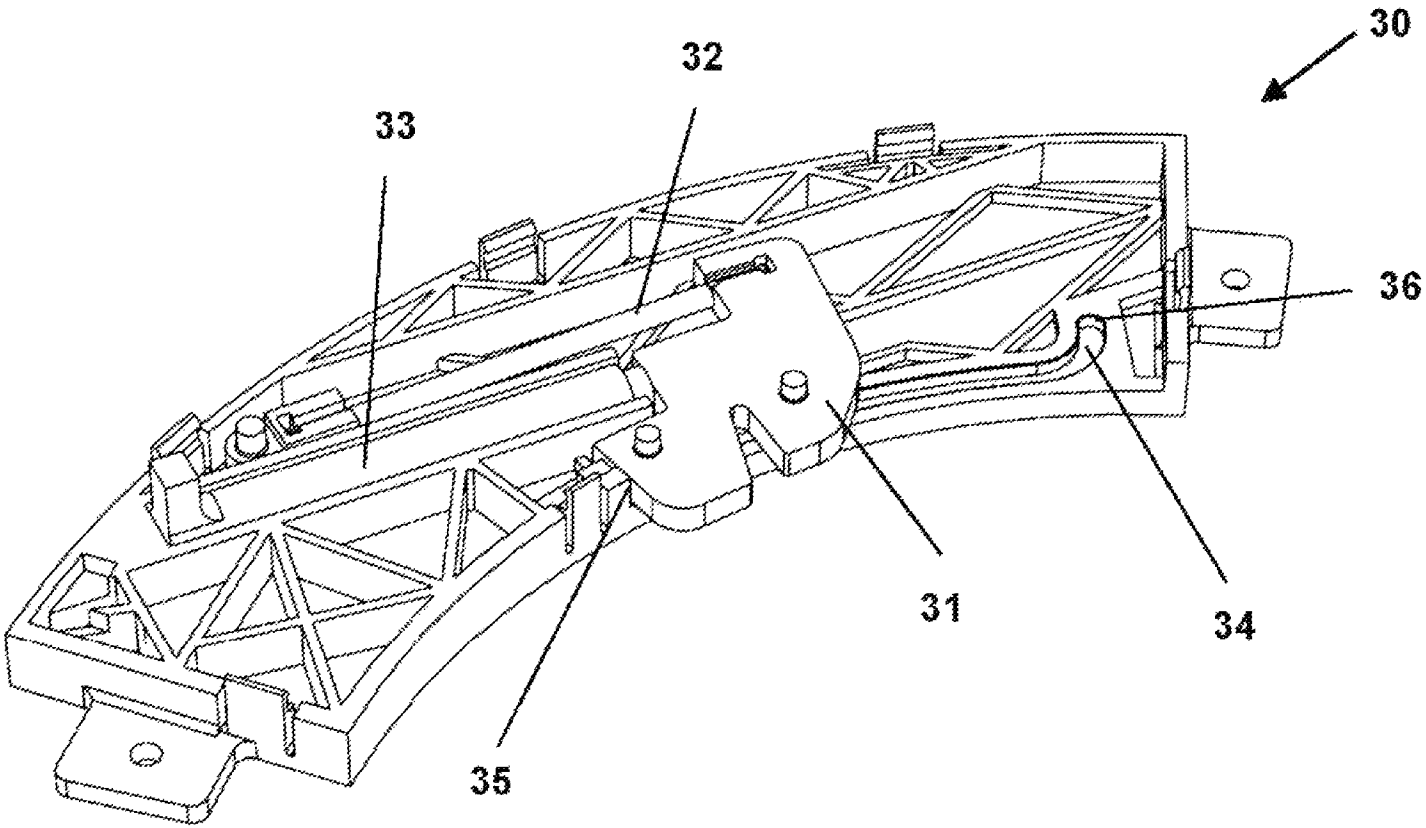
Figure 16:
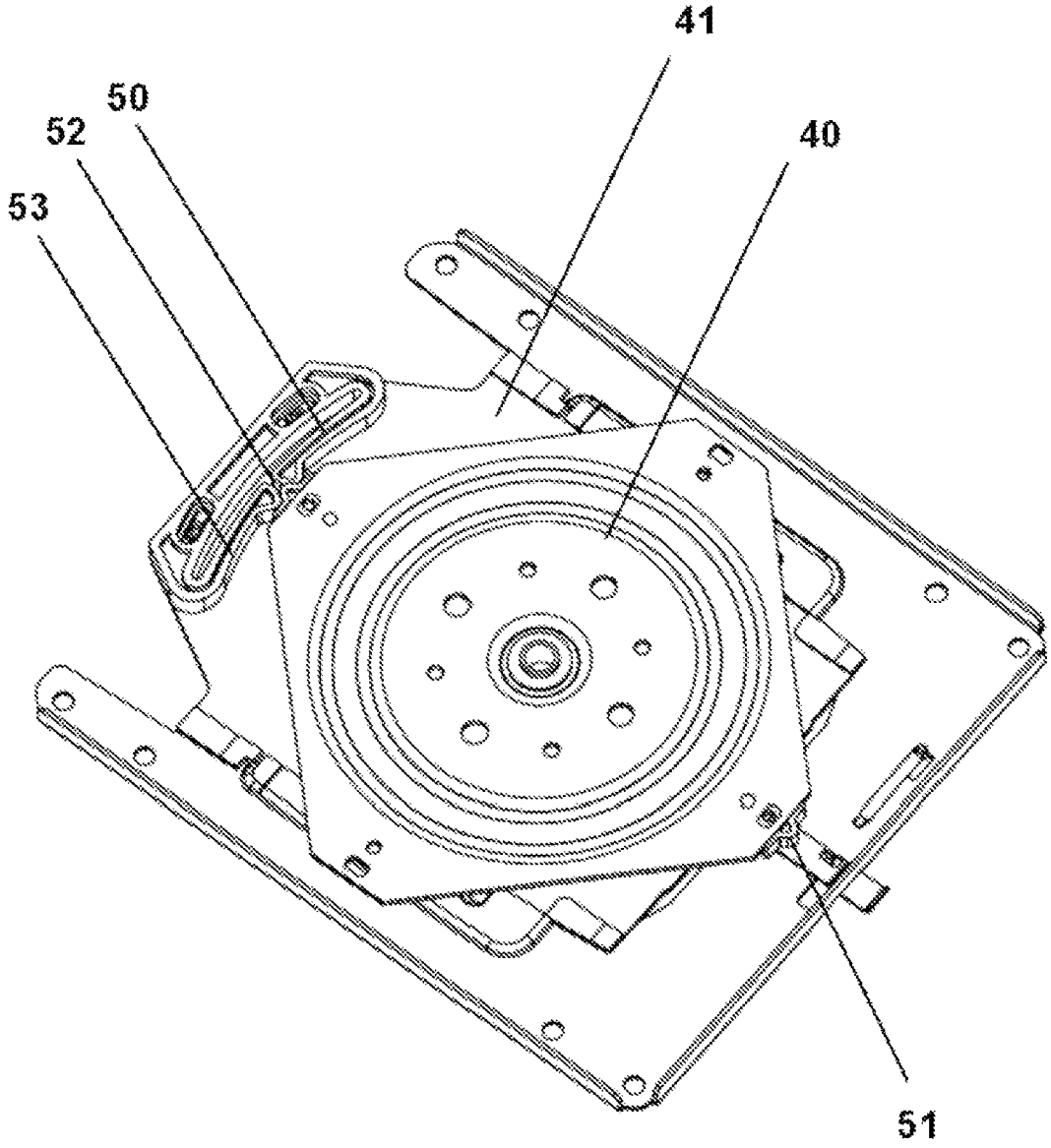
Figure 17:
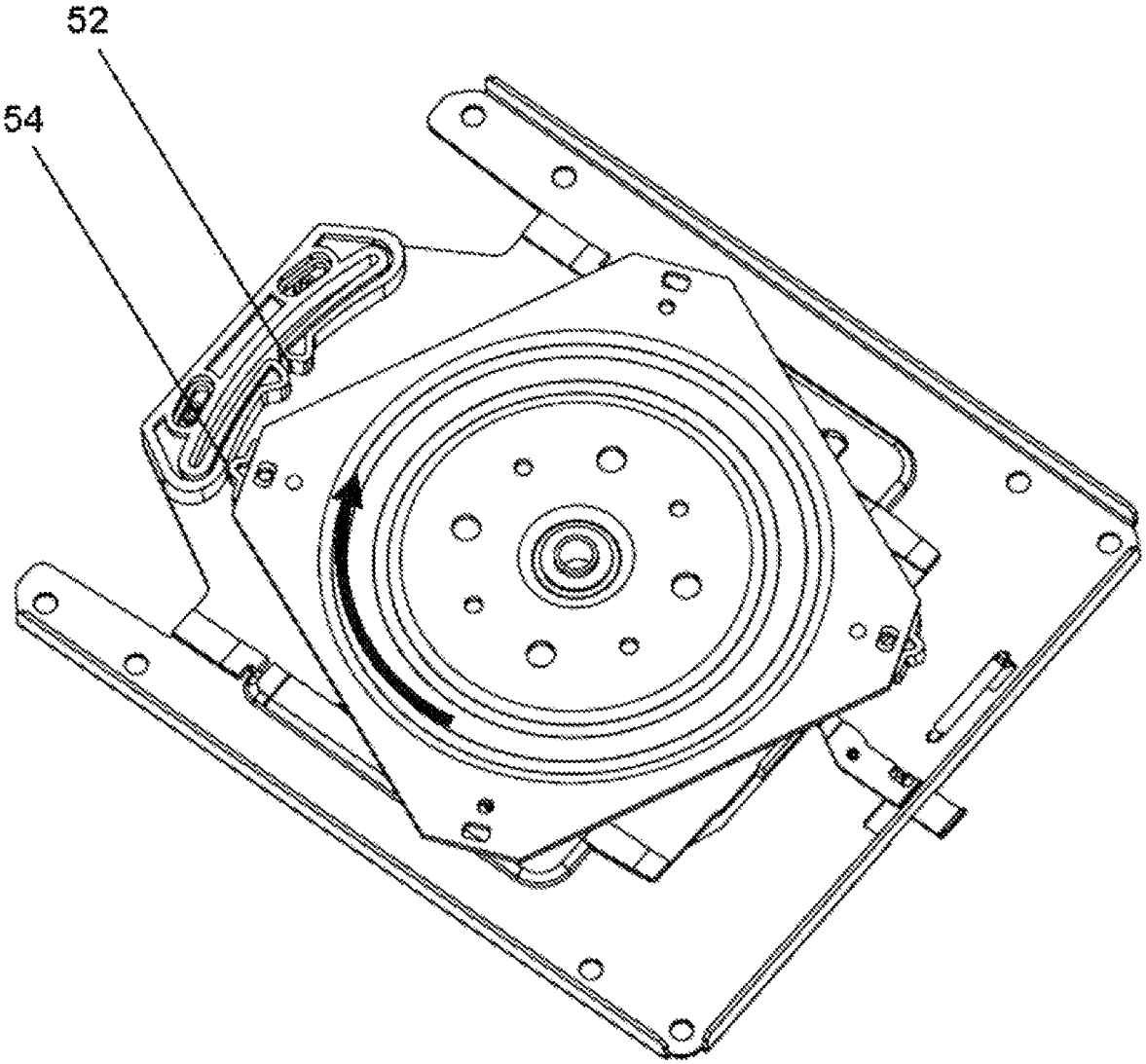
Figure 18:
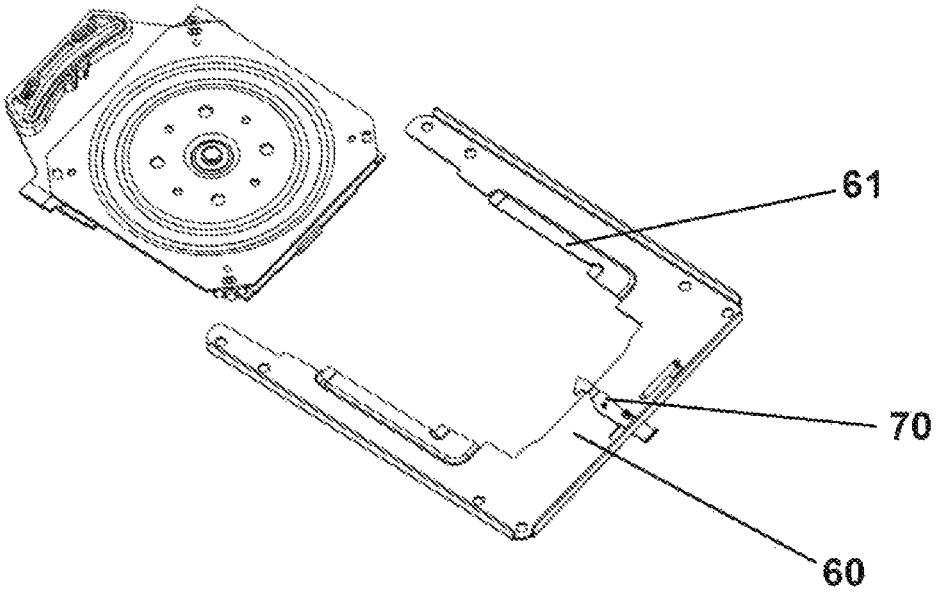
Figure 19:
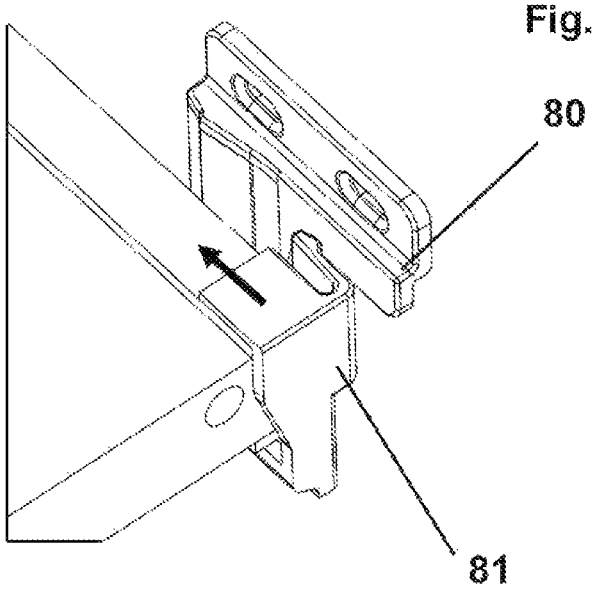
Figure 20:
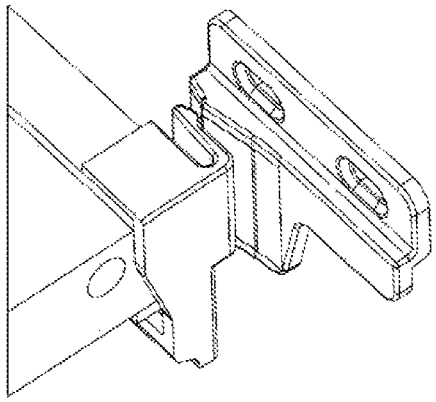
Figure 21:
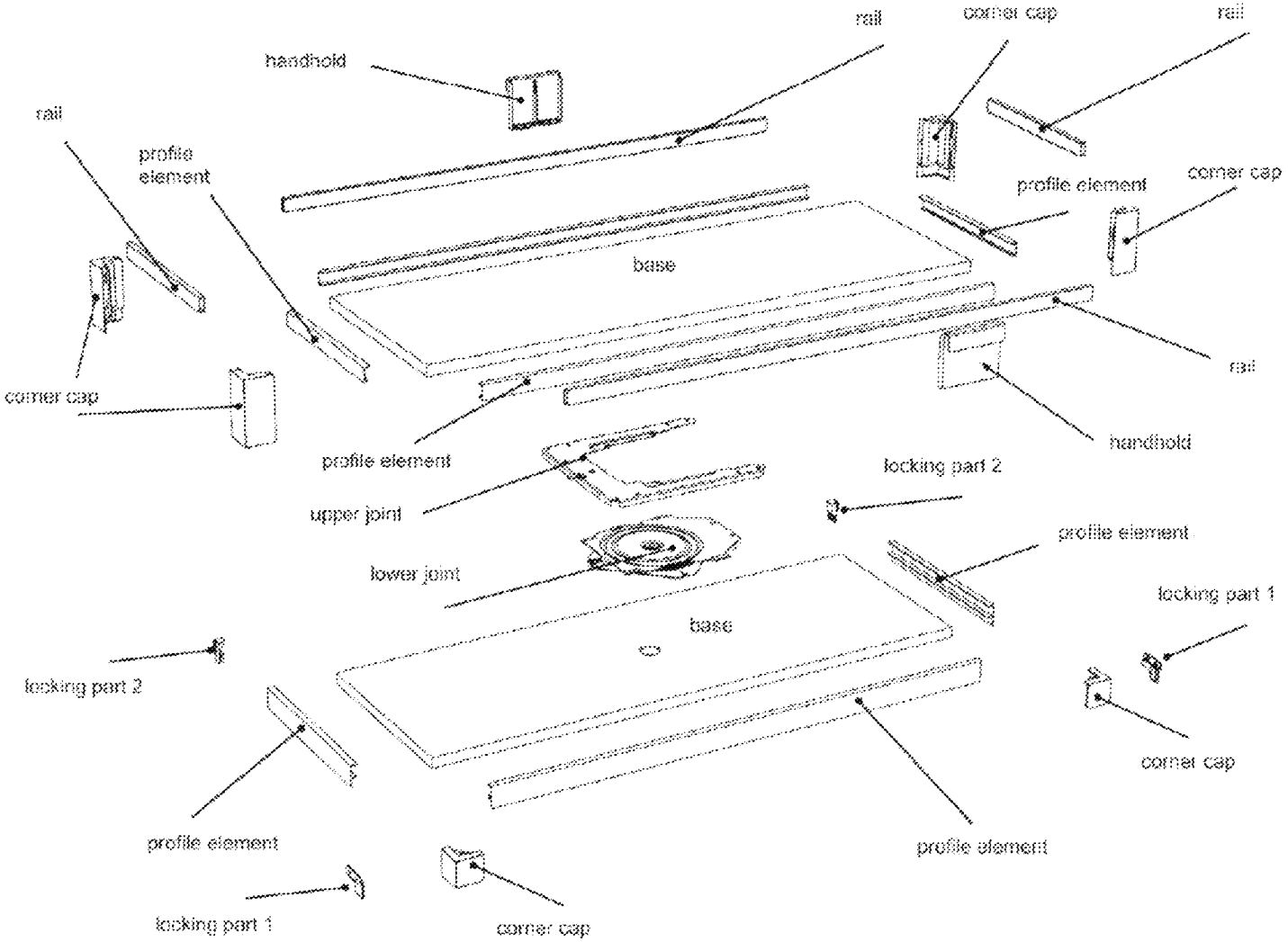

FIG. 1 a perspective view of a first embodiment of the cupboard of the invention;

FIG. 2 an exploded view of a first embodiment of the cupboard of the invention;

FIG. 3 a further exploded view of the first embodiment of the cupboard of the invention;

FIG. 4 a perspective view, laterally from below, of the first embodiment of the cupboard of the invention, with the shelf taken out;

FIG. 5 a perspective view, laterally from above, of the first embodiment of the cupboard of the invention, with the shelf the other way around and taken out;

FIG. 6 a perspective view, laterally from below, of the first embodiment of the cupboard of the invention, with the shelf put back;

FIG. 7 a perspective view, laterally from below, of a second embodiment of the cupboard of the invention, with the shelf taken partly out;

FIG. 8 a perspective view, laterally from above, of the second embodiment of the cupboard of the invention, with the shelf taken all the way out;

FIG. 9 a perspective view, laterally from below, of the second embodiment of the cupboard of the invention, with the shelf taken all the way out;

FIG. 10 a perspective view, laterally from above, of the second embodiment with the shelf pulled all the way out and the other way around;

FIG. 11 a plan view of an arrangement according to the invention of two guide elements according to the invention on a revolute joint;

FIG. 11' a view, rotated by 90°, of an arrangement according to the invention of two guide elements according to the invention on a revolute joint;

FIG. 12 the arrangement according to the invention of FIG. 11 of two guide elements according to the invention on a revolute joint, in which both slaving means are located in spring-loaded fashion in the second terminal position;

FIG. 13 the arrangement, according to the invention of FIG. 11, of two guide elements according to the invention on a revolute joint, in which the portable element 13''' as a result of a clockwise rotation faces the slaving means 31' and is about to release the slaving means from its detent position to its first terminal position;

FIG. 14 the arrangement, according to the invention of FIG. 11, of two guide elements according to the invention on a revolute joint, wherein the portable element 13''' faces the slaving means 31', and the slaving means 31' is moving the portable element ''' in spring-relaxing and damped fashion in the direction of the second terminal position;

FIG. 15 a perspective view of a guide element of the invention shown separately;

FIG. 16-17 two engaging elements located on the rotatable part of the revolute join;

FIG. 18 shows the revolute joint and its receptacle 60 separately from one another;

FIG. 19-20 a retention mechanism can be provided, which can be secured to a rear side of the drawer and on an inner side of a carcass; and FIG. 21 shows an especially preferred embodiment of the entire drawer, which is shown in an exploded view and shows individual parts of such a drawer.

FIG. 1 shows a cupboard 10 of the invention, on which a shelf 11 is supported such that it can be pulled out and is rotatable. The shelf 11 can have side walls 15, 16, which are located so they can be folded in and out, in order to position it in an approximately horizontal orientation. In principle, all the side walls of the shelf 11 can have this function.

FIG. 2 shows an exploded view of the cupboard 10 of the invention having an adjusting mechanism for linearly adjusting (pulling out) the shelf 11 and rotating it horizontally. For that purpose, the adjusting mechanism can have at least one, and preferably two, guides 14, for instance in the form of a linear pull-out device, and the guides can cooperate with a revolute joint 13. The revolute joint 13 can also be embodied with a turntable. As a connecting element between the revolute joint and the guide, a board 12 or a rod system can be provided, on which the revolute joint 13 can be located. Fundamentally, the revolute joint can also be in direct contact with the guides 14. Relative to the adjustment mechanism, in particular the guides 14 or the carcass 10' of the cupboard 10, the shelf 11 can be supported rotatably via the joint 13.

FIG. 3, in greater detail, shows an exploded view of the first embodiment of the present invention, which further shows that the shelf 11 can be composed of both a shelf base and side walls 15 and 16, which are able to cooperate via corner elements 14 to surround the shelf base. Particularly in the corner elements 14, joints can be provided by way of which the side walls 15 and 16 can be supported pivotably about a horizontal axis of the shelf. As a result, the side walls can be lowered, in order to gain easier access to the objects stored on the shelf 11. Instead of the inclination about a rotary axis, the wall can also be shifted, for instance vertically downward, in order to obtain easier access to the shelf 11. For that purpose, suitable guides can be provided. The board 12 can be called a platform and can be furnished as a connection between the revolute joint 13 and the guides 14.

FIG. 4 shows a variant of the embodiment of FIGS. 1-3, in which the platform 12 is embodied as a cross linkage, at the crossing point of which a receptacle 12' for the revolute joint 13 can be furnished. Fundamentally, a structural connection can be furnished between the guide and the revolute joint. In FIG. 4, the shelf 11 has been pulled out as far as possible from the carcass 10', so that the shelf 11 can be rotatably freely relative to the carcass 10'. This kind of rotatability can be seen in FIG. 5, for example, in which a front region 11; of the shelf 11 faces toward the opening of the carcass; that is, the shelf has been rotated outward by almost 180° or by more than 180°. The shelf can be large enough that inside the cupboard itself, it cannot be rotated freely, but instead becomes freely rotatable only once it has been pulled out of the cupboard via the guide.

As FIG. 5 shows, the side walls can in principe also be furnished in the form of individual struts, which via corner pillars can form a rail around the shelf 11.

FIG. 6 shows a further embodiment of the present invention, which instead of the classical guides 14 has a scissors mechanism or cross mechanism 20 as a pull-out device, by means of which the shelf 11 can be pulled out of the carcass 10'. The mechanism 20 can be formed with at least one and preferably two pairs of arms or (elongated) means. For bracing the mechanism, and/or as a guide for the first pair of elongated means 15, 15' against the carcass, a support arm 17 can be furnished, along which the first pair of (elongated) means 15, 15' can rest in sliding fashion. In an end region of the individual elongated means of the first pair of elongated means 15, 15' there can be an adjoining second pair of (elongated) means 16, 16', which is able to support the revolute joint 13 individually or jointly. The individual (elongated) means of the two pairs can be connected to one another in articulated fashion, either directly or indirectly. The individual elongated means can also be called scissors elements.

As can be seen particularly from FIG. 8, the support arm 17 can have a guide element 17*a*. At least one of the two elongated means 15, 15' can be guided along this guide element. Preferably, at least one of the two elongated means 15, 15' also has a guide element 15*a*, 15*a*', which cooperates with the guide element 17*a* of the support arm. Particularly in this embodiment, the support arm can also be called a guide arm, although it is not imperative for it to provide a supporting function. For cooperation of the individual guide elements 17*a*, 15*a* and/or 15*a*', a connection means, such as a bolt, can be provided, which can slide along, and in particular in, at or on top of, the individual guide elements. Thus a guide region or guide element that can function simultaneously as a joint can be formed. Especially the guide elements of the two elongated means 15, 15' can be limited in their length, and as a result, a maximum outswing distance of the drawer can be established. If the connecting means has reached a front end region of a guide element, in or at or on which it moves, a terminal pull-out position can be attained.

FIG. 9 shows the s or crosswise arrangement of FIG. 8 in a perspective view from below. From this, it can be seen that the elongated means 15' has reached a terminal region or the guide or support 17, and thus a terminal pull-out position of the shelf 11 can be reached. In that position, the shelf 11 can protrude far enough out of the carcass 10' that free rotatability of the shelf 11 about the joint 13 or the rotary axis of the joint is enabled. In this terminal position, the shelf 11 preferably protrudes all the way out of the carcass 10'.

FIG. 10 shows the shelf 11 on the above-described or crosswise arrangement in a rotated position, in which a front part of the shelf 11 projects rearward. It is accordingly possible to furnish rotatability of the shelf 11 such that the various corners of the shelf 11 can be moved past the side walls of the carcass 10' without contacting the carcass in such a way as to damage the material. Such damage can be prevented according to the invention when the shelf 11 is in the pushed-in position. Both of these embodiments are to be understood merely as examples for how the present invention of an adjustment mechanism can make it possible to linearly displace and rotate a shelf about an axis. In principle, a door can be mounted on the cupboard, and the door can be closed whenever the shelf 11 is located inside the carcass in the retracted position described.

FIG. 11 shows a preferred embodiment of the revolute joint 13, which can also be embodied with a turntable. The revolute joint 13 can have a first region 13', which can be fixed opposite the mechanism 22 or the platform 12, in other words opposite a part that can be pulled out of the cupboard. For that purpose, recesses 35, for instance in the form of bores, can be provided, by way of which the mechanism can be fixed relative to the part of the cupboard that can be pulled out. Preferably, by way of these recesses, the revolute joint 13 can be screwed or riveted to the part that can be pulled out. The revolute joint 13 can furthermore have a a second part 13", which is rotatably supported relative to the part of the cupboard that can be pulled out. The rotatable support can in particular exist relative to the first part 13'. The rotatable second part 13" can be furnished by a portable element 13'", which can also be called a pivot or a means that protrudes (in the direction of the rotary axis). Upon a rotation of the second part 13" of the revolute joint 13, the portable element 13'" can also perform the motion of the second part 13", because that element can be secured to the second part. A guide element 30 can also be provided, which can be secured relative to the pull-out part of the cupboard and can interact with the portable element 13'". The guide element 30 can have a slaving means 31, for instance in the form of a hook or a receptacle, which can be furnished and arranged so as to interact with and preferably guide the portable element 13'''. The interaction can in particular consist in that the portable element 13''' is located in a receptacle of the slaving means 31, if the portable element 13''' is provided in a suitable position relative to the guide element 30. Depending on which function the guide element 30 has at the moment, the portable element 13''' can guide the slaving means 31, or the slaving means 31 can guide the portable element slaving means 31, if the portable element 13''' is provided in a suitable position relative to the guide element 30. Depending on which function the guide element 30 has at the time, either the portable element 13''' can guide the slaving means 31, or the slaving means 31 can guide the portable element 13'''. This relationship will be explained further hereinafter.

The portable element 13''', in particular in an angular portion of the rotation of the revolute joint 13 about its own axis, can be delivered to the slaving means 31. The slaving means 31 can cooperate with a spring 32 and/or a damper 33, and the slaving means 31 can be feasibly supported along a link/link guide 34. Counter to the spring force of the spring 32, the slaving means 31 can be movable along the link 34 into a first end region, in which the slaving means 31 can at least partially be spaced apart radially from the axis of rotation of the revolute joint 13. In particular, as shown in FIG. 11 on the right-hand side of the drawing, this can be a lower end region of the link 34. In this position the slaving means 31 can be in a position in which the portable element 13''' is at least partially released from the receptacle of the slaving means 31, as a result of which a (clockwise) rotation of the portable element 13''' (with the revolute joint) out of a region of contact with the slaving means 31 is made possible. The link can nestle closely in an outer contour of the joint 13, in particular a circumference of the joint.

This terminal position of the slaving means 31 is shown for example on the left-hand side of FIG. 11 for the slaving means 31'. In this position, the slaving means 31 is prepared for receiving the portable element 13'''. By contact of the portable element 13''' with the slaving means in the latter's first terminal position, as is shown in FIG. 11 for the slaving means 31', the slaving means can be moved or pressed out of the first terminal region (detent region), which is spaced apart radially from the axis of rotation of the revolute joint 13; as a result, the spring, not shown in further detail on the left side (30') and which in that position is tensed, can be relaxed. The spring leads the slaving eans 31 through the link 34 approximately at a tangent to the revolute joint 13, while the spring 32 at least partially relaxes. The damper 33 can be located oppositely from the direction of the relaxation movement of the spring 32. As a result, the relaxation of the spring 32 and thus also the movement of the slaving means 31 in damping fashion, especially along the link 34, is accomplished.

If a (second) terminal position in the link 34, a maximally inserted damping position of the damper 33 or a maximal relaxation of the spring 32 is achieved, then the slaving means 31 has reached its second terminal position, in which it is placed at least partially closer to a rotary axis of the revolute joint 13 than in the first terminal position already described above.

The link 34 can be approximately equivalent to the circumferential shape of the revolute joint 13, in particular the shape of the outer circumference of the first part 13' or approximately the shape of the outer circumference of the first part 13', or can be embodied approximately tangentially to the revolute joint 13. Preferably, the spring and/or damper are approximately parallel to one another in their orientation and/or are tangential to the revolute joint 13, in particular tangential to the point of the revolute joint 13, in which the slaving means 31, in the position shown there on the right-hand side, is positioned relative to the revolute joint 13 such that it is in engagement with the portable element 13'.

By a clockwise rotation of the upper cupboard out of the position of the portable element 13' shown in FIG. 11, the portable element 13' (which rotates along with the rotation of the shelf 11 via the revolute joint 13), the slaving means 31 moves out of the position shown there on the right-hand side, to the radially spaced-apart position, counter to the spring force of the spring 32. This position is shown in FIG. 12, for example, in which the slaving means 13''' has reached its at least partially radially spaced-apart first terminal position, and the portable element 13''' departs from the reception of the slaving means 31 upon a clockwise rotation of the revolute joint. The first terminal region of the link 34 can be furnished by a detent/bearing point or a detent/bearing receptacle, in which the slaving means 31 can be supported counter to the spring tension 32. By means of an approximately linear shifting of the slaving means, a rotary motion of the revolute joint can thus be enabled.

On the revolute joint 13, there are preferably two guide elements 30 provided along the circumference of the revolute joint 13; preferably, the first end points of the guide link, in which the receptacle of the slaving means 31 is spaced apart at least partially radially from the portable element 13''', point along the circumference of the revolute joint relative to one another.

FIG. 12 shows both slaving means 31 and 31' in the first terminal position of each of them. By their relative positioning along the outer circumference of the revolute joint 13, the portable element 13''' is able to move between the two terminal positions of the two slaving means 31 and 31' (along the circumference) of the revolute joint 13. A rotation that goes beyond the above can be limited by means of the impact of the slaving means 31 and 31' on the respective damper 33, 33' and a second terminal position 35 and 35', respectively, along the respective link 34 and 34'. The slaving means 31 can accordingly be embodied so that it departs from the portable part 13''' only toward one side, or in other words to leave its receptacle only upon the either clockwise or counterclockwise rotation of the revolute joint.

If, as shown in FIG. 11, the portable part 13'' is provided only on the right-hand side in the slaving means 13 when that means is in its second terminal position, then by the clockwise rotation of the revolute joint 13 or of the shelf 11, the spring 32 is tensed, and the slaving means 31 shifts into its first terminal position of the link. In that process, the portable element 13''' guides the slaving means 13 to its first terminal position. Conversely, if the portable element 13''' is delivered to the slaving means 31 and in the process the slaving means 31 moves out of its first terminal position, the spring relaxes counter to the damping action of the damper 33, and the slaving means 31 guides the portable element 13''' in the direction of its second terminal position.

Whether the portable element 13''' or the slaving means 31 determines their common motion along the link 34 accordingly depends on the starting point of the slaving means 31 in the link 34.

The two guide elements 30 and 30' can be provided at an arbitrary angle from one another along the outer circumference of the joint 13. In FIG. 11, they are oriented at approximately at a 180° angle to one another. As a result, the rotatability of the shelf 11 and/or the link 13 is limited to an angle of approximately 180°. The limitation of the rotatability of the receptacle or of the joint 13 can depend in particular on the angular position of the two slaving means 31 and 31' in both of their terminal positions, as shown for example in FIG. 11 on the right-hand side on the slaving means 31.

By a relative positioning of the two slaving means 31 and 31' along an outer circumference of the joint 13, a rotary angle of the revolute joint 13 and of the shelf 11, which is secured to the revolute joint 13, can be adjustable. The revolute joint can rotate between the two second terminal positions only as far as the portable element 13''' permits.

For the mode of operation of the guide elements 30 in cooperation with the portable element 13''', it is fundamentally unimportant whether the guide elements 30 and 30' are located on the shelf 11 and the portable element 13''' is provided on a static part of the revolute joint 13, or the other way around. Conversely, what can be decisive for the invention that the portable element 13''' and the guide elements 30 and 30' are secured on different parts of the revolute joint or on different parts of the pull-out unit. One of the parts (30, 30')/13 should be located at least on a static region, that is, a region that is not rotatable, while the other part can be located on a rotatable part, such as the joint or the shelf 11. The first terminal position along the link 31 is identified in FIG. 15 by the reference numeral 36.

In summary, it can be determined that the present invention, in both this and other embodiments, relates to a drawer/shelf that can be pulled out of a cabinet carcass and that is fundamentally rotatably supported.

It can preferably be provided that, while free rotatability of the drawer/shelf on a revolute joint is made possible, nevertheless the free rotatability can be interrupted on account of an interaction of the revolute joint with means for positioning the rotatable part of the drawer/shelf in certain positions; that is, a fixation of the drawer/shelf in a certain position is enabled. This fixation can be overcome; for example, the drawer can be released from the fixation or the fixed position.

Especially preferably, the fixation can be accomplished in damped and/or guided fashion, as a result of which vibrations that can for instance be traced back to the fixation are reduced or can be averted.

Fundamentally, it can be preferable that the drawer is movable back and forth between one or more fixations or is fundamentally freely rotatable, i.e. by 360°, while the rotatability in the region of the fixation is interrupted if the fixation needs to be overcome.

FIG. 15 shows a further embodiment of the present invention, which can function fundamentally on the same principle as the first embodiment.

The concept can be described this way: a revolute joint 40 is furnished, on which a drawer/shelf, i.e. a storage option for a drawer can be located. In comparison with a base body of the drawer that can be pulled out, it can be provided that the storage option can be rotatable.

The base body can also be limited to a mechanism for pulling out the drawer/shelf.

The revolute joint can have a part 41 that can be affixed to the base body of the drawer and that is preferably fixed thereon.

Retention means 50, 51 are preferably furnished, which make it possible, despite the free rotatability of the revolute joint, to enable a fixation of the rotatable part, that is, of the attachment/shelf on the revolute joint in a predefined rotary position.

To that end, a (resilient) receptacle, which can also be called a shaped spring 50, can be furnished on the revolute joint or a fixed (non-rotatable) part of the drawer. As a counterpart, a retention element 51, which can be reversibly fixed in or can engage the receptacle, can be furnished, which can also be called an engagement element 51, such as a nib or pivot, can be accordingly furnished on a fixed part of the drawer or furnished to the revolute joint.

Thus a first one of these two parts (receptacle, retention element) can be furnished on the revolute joint 40, and a second one of the two parts can be furnished on the gase body or fixed part of the drawer. A fixed opart of the drawer can in particular be a nonrotating part or stationary part of the pullout of the drawer.

The receptacle, such as a shaped spring 50, can for instance be embodied like an open pretzel, of the kind shown in FIG. 15. Basically, the shaped spring 50 can have at least two functions. First, it can provide a receptacle 52, in which the engaging element 51 can be reversibly fixed, as a result of which the rotatable part of the drawer can be fixed in a (rotary) orientation, which is equivalent to an engagement of the engaging element in the receptacle of the shaped spring. If the engaging element is fixed in the receptacle of the shaped spring, it can as a result be possible to fix the drawer in a rotated position.

A second function of the shaped spring can be to accommodate the momentum of the rotatable part of the drawer before the the engaging element 51 is fixed, or in other words to slow down the rotary motion of the shelf/drawer before providing a fixation.

This can counteract damage to the shaped spring 50, since the rotatable part of the drawer/shelf does not first, in the receptacle 52, have to slow the full speed of the rotary motion down to zero. For that, a contact region 53 on the shaped spring can be provided, which can at least in some regions be in contact with the engaging element 51. This contact means 54 can be seen for example in FIG. 17, in which the engaging element 51, although already in contact with the shaped spring 54, has nevertheless yet been located/fixed in the receptacle 52 of the shaped spring 50 (FIG. 16).

The contact region 53 of the shaped spring 20 with the engaging element 51 can be in contact via spring tension, which can increase as there is a closer and closer approach of the engaging element 51 to the receptacle 52 at the shaped spring. The shaped spring can therefore be spaced apart from a circular path of the element 51 around the revolute joint by an amount that decreases, the closer (as a function of this) the element 51 comes to the receptacle 52. As a result, a part of the spring can experience a bending force, originating at or in other words because of the element 51, which can furnish a braking sliding contact between the element 51 and the spring 20.

Thus by means of a kind of sliding contact, the rotary speed of the rotatable part of the drawer can be decreased, before the engaging element 51 reaches into the receptacle 52 of the shaped spring 50. The shaped spring, which can also be called a capturing element, can be formed either symmetrically or asymmetrically. This shaping can extend in particular along a path surrounding the element 50. At least in a symmetrical construction, the engaging element can be detachable from the receptacle 52 on both sides, or in other words can perform a rotary motion on both sides of the shaped spring.

Fundamentally, it can be possible, by an appropriate exertion of force on the rotatable part 40 of the revolute joint, to overcome the reluctance of the shaped spring 50, and in particular its receptacle 52, and to set the engaging element free from the receptacle 52 of the shaped spring 50.

As a result, a further rotation of the revolute joint is enabled beyond the contact point/region between the receptacle 52 of the shaped spring 50 and the engaging element 51. Fundamentally, a plurality of shaped springs 50 and/or engaging elements 51 are provided on the rotatable part 40 of the revolute joint and/or the fixed part (that is, the nonrotating/static part). As a result, a plurality of (rotational) locking positions for the rotating part of the drawer/receptacle can be furnished on the adjustment mechanism.

In FIGS. 16 and 17, two engaging elements 51 are located on the rotatable part 40 of the revolute join, on opposite sides thereof, and a shaped spring 50 is provided on the fixed part of the drawer, or the fixed part of the revolute joint 41 (which can be displaceably supported via the adjustment mechanism). As a result, the rotatable part of the drawer/receptacle can be fixed in two positions, and between the positions, a rotation of 180° is made possible.

The retension/retension force of the shaped spring 50 on the engaging element 51 in the engagement of the two shown in FIG. 16 can be overcome by exerting appropriate force on the rotatable part of the revolute joint, preferably in both directions, and as a result in total a rotation of the drawer by 360° or more can be enabled.

The shaped spring can also be called a receiving element 50 for reversible fixation of an engaging element 51 or of a region of the rotatable part 40 of the revolute joint for a drawer or support. The reversible fixation can be done from the pickup element 50 outward in both rotary directions of the revolute joint.

For especially easy mounting of the revolute joint, it can be provided that a receptacle 60 for the revolute joint is furnished on the fixed part of the drawer. This can be provided as U-shaped or horseshoe-shaped, and the revolute joint with its part 41 that is fixed/to be fixed/nonrotating can be placed in or introduced into a preferably open region of the receptacle or can be connected to it.

For fixation of the revolute joint on the fixed part of the drawer, or in other words on the nonrotably supported part of the drawer, a fixation element, for instance in the form of a hook, can be provided, which keeps the revolute joing in the receptacle 60.

FIG. 18 shows the revolute joint and its receptacle 60 separately from one another; guide rails 51 which can align the revolute joint, and in particular the fixed part 41, can be furnished positionally accurately in the receptacle.

Especially preferably, it is provided that the drawer, after being pulled out, caln be retained in an open position. To that end, in FIGS. 19 and 20, a retention mechanism 80, 81 can be provided, which can be secured to a rear side of the drawer and on an inner side of a carcass, and when the drawer is pulled out all the way or as needed they mesh with one another (can be inserted or latched), so that a certain pressure has to be exerted in order to free the drawer from the receptacle 80 of the retention mechanism in order to free it so it can be returned to the carcass, This pressure force can preferably beset as greater than the pressure force that must be exerted on the rotatable part of a drawer in order for the revolute joint/engagement element of the rotatable part of the drawer to be freed from the receptacle 50 in which the drawer is fixed in an orientation of the rotary motion. As a result, rotatability of the drawer outward via the above-mentioned locking point, for example in the form of the shaped spring 50, is enabled, without the drawer being pushed back into the carcass by mistake.

The locking means 80, 81 can in particular be embodied as a latchable pair of hooks (see FIG. 20).

Alternatively, for releasing the retention mechanism 80, 81, an actuatable regions, key, or lever can bd provided that is operatively connected to the retention mechanism and that can undo the locking.

FIG. 21 shows an especially preferred embodiment of the entire drawer, which is shown in an exploded view and shows individual parts of such a drawer.

Fundamentally, each of these individual parts can be can be provided, without a further part and in arbitrary combination, so as to implement the present invention.

The invention claimed is:

1. A cupboard having a carcass, a shelf, consisting of four side walls, a bottom surface, and an open top, and an adjustment mechanism, by means of which the shelf is linearly displaceable on a horizontal axis and is rotatable along the same horizontal axis by 180 degrees to permit access to contents of the shelf from all side walls of the shelf, and a revolute joint, about the rotary axis of which the shelf is supported rotatably on the adjustment mechanism, characterized in that at least one retention mechanism is furnished, which is embodied for reversibly fixing the shelf in a predefined rotary position, having a resilient receptacle and a retention element that is reversibly fixable in the receptacle.

2. The cupboard of claim 1, characterized in that the adjustment mechanism has a pull-out device in the form of a scissors pull-out device or a rail pull-out device, for linearly displacing the shelf.

3. The cupboard of claim 1;

characterized in that the revolute joint is fixed relative to a displaceable/adjustable part of the adjustment mechanism.

4. The cupboard of claim 1, characterized in that the adjustment mechanism has a fixation means, which releasably fixes the shelf and/or the adjustment mechanism in a pulled-out position.

5. The cupboard of claim 4, wherein the fixation means comprises a latchable pair of hooks.

6. The cupboard of claim 1, characterized in that the revolute joint is embodied for rotationally shifting the shelf between at least two orientations.

7. The cupboard of claim 6, characterized in that at least one fixation position is furnished by the retention mechanism in one of the at least two orientations of the shelf in which said at least one fixation position the shelf is latchable.

8. The cupboard of claim 1, characterized in that the four side walls are foldable, which can be lowered away from the shelf.

* * * * *